United States Patent [19]

Carter

[11] Patent Number: 4,960,170

[45] Date of Patent: Oct. 2, 1990

[54] FINNED TUBE AND METHOD OF MAKING THE SAME

[76] Inventor: James I. Carter, P.O. Box 470523, Tulsa, Okla. 74147

[21] Appl. No.: 301,967

[22] Filed: Jan. 26, 1989

[51] Int. Cl.[5] ..... F28F 1/36

[52] U.S. Cl. ..... 165/184; 165/81; 165/182; 29/890.048

[58] Field of Search ..... 29/157, 3 AH; 165/182, 165/184, 81

[56] References Cited

U.S. PATENT DOCUMENTS

| | | | |
|---|---|---|---|
| 2,161,898 | 6/1939 | Ledbetter | 165/184 X |
| 2,182,238 | 12/1939 | Rasmussen | 29/157.3 AH |
| 2,268,680 | 1/1942 | Von Linde | 165/184 |
| 3,177,937 | 4/1965 | Slough | 165/184 |

FOREIGN PATENT DOCUMENTS

| | | | |
|---|---|---|---|
| 54-39245 | 3/1979 | Japan | 165/184 |

*Primary Examiner*—Martin P. Schwadron
*Assistant Examiner*—Allen J. Flanigan
*Attorney, Agent, or Firm*—William S. Dorman

[57] ABSTRACT

In a finned tube product of the type having a flat thin fin wound helically on a heat exchange tube, wherein the fin is made from a material having a relatively higher coefficient of thermal expansion than the material of the tube, the improvement which comprises winding a wire helically on the surface of the tube in side by side relation with the fin and simultaneously with the winding of the fin on the surface of the tube such that each winding of wire is snuggly received between adjacent windings of fin, the wire being made of a material having essentially the same or smaller coefficient of thermal expansion as compared to the material of the tube and the longitudinal dimension of thickness of wire representing the desired spacing between adjacent windings of fin on the tube. When the resulting finned tube is heated to temperatures in excess of ambient temperature, the fin can expand outwardly with relation to the tube but will remain in physical contact with the wire so as to provide a continuous path of heat conduction from the tube to the fin.

8 Claims, 1 Drawing Sheet

FINNED TUBE AND METHOD OF MAKING THE SAME

BACKGROUND OF THE INVENTION

1. Field of the Invention

The present invention relates to a steel tube having aluminum fins wound helically thereon. More particularly, this invention relates to an improved form of finned tube and the method of making the same.

2. Prior Art

In the heat exchange art, one conventional exchange unit consists of a cylindrical steel tube upon which a thin aluminum fin is helically would or attached. In order for the heat exchange unit to operate effectively, it is necessary that there be a heat-conductive union between the tubular body and the helical fin.

However, one problem arises from the fact that steel and aluminum have different coefficients of thermal expansion. That is, if the aluminum fin is tightly wound around the steel tube at ambient temperatures, the fin will expand away from the tube when the elements are heated; thus, bringing the fin out of contact with the tube so that the fin will be unable to conduct heat away from the tube.

One prior art proposal to obviate the above noted problem, is to provide a helical groove or recess in the tube and to wind the aluminum fin in the groove. If the groove is properly sized as to width and depth, the fin will still remain in contact with the tube even though it expands outwardly in the groove.

A patentability search was conducted on the present invention and the following listed U. S. Patents were uncovered in the search.

| U.S. Pat. No. | Inventor | Date |
|---|---|---|
| 877,252 | Stolp | 1-21-08 |
| 2,152,331 | Shoemaker | 3-28-39 |
| 2,182,238 | Rasmussen | 12-05-39 |
| 2,268,680 | Von Linde | 1-06-42 |
| 2,270,810 | Larriva | 1-20-42 |
| 2,310,970 | Limpert | 2-16-43 |
| 2,379,879 | Bronander | 7-10-45 |
| 2,396,795 | Lea | 3-19-46 |
| 2,453,448 | McTurk | 11-09-48 |
| 2,252,092 | Bruegger | 10-10-50 |

The closest patent appears to be the Shoemaker Pat. No. 2,152,331, which shows, in FIG. 3, a fin 11 helically wound around a tube 10. Elements 12 and 13 are described as stabilizing strands. In FIG. 3 of the Shoemaker patent, the strands are triangular in cross section; in FIG. 6, they are square; in FIG. 8 they are round. On page 2, column 1, lines 30–32, it is stated that the stabilizing strands can be of any other suitable cross section. In the Shoemaker patent, the stabilizing strands are fastened to the tube by a bath of solder or by brazing the ends to the tube. In no event, however, does the Shoemaker patent teach or suggest the simultaneous wrapping of the fin and the stabilizing strands. Furthermore, the Shoemaker patent does not show or suggest the feature of simultaneously winding a fin and a wire to provide an alternate contiguous relationship.

SUMMARY OF THE INVENTION

A finned tube product and method of making the same which comprises helically winding a piece of fin stock, preferably of aluminum material, and having a thin flat configuration on a heat exchange tube, preferably of steel while simultaneously winding a wire helically on the tube in side by side relation with the fin on the surface of the tube such that each winding of wire is singly received between adjacent windings of fin, the wire being made of a material having the same or similar coefficient of expansion as compared to the material of the tube, the longitudinal dimension of the wire being equal to the desired spacing between adjacent fin windings.

In one embodiment of the invention, the cross sectional shape of the wire is round while in another embodiment the shape is square or rectangular. When the resulting finned tube is used at temperatures higher than ambient temperatures, the fin can expand away from the tube while remaining in physical contact with the wires such that there is always a thermally conductive path from the tube to the fins.

DETAILED DESCRIPTION OF THE DRAWINGS

As indicated heretofore, one of the purposes of the present invention is to provide a finned tube made from an aluminum fin helically wound on a steel tube, wherein, an effective heat conductive union is maintained between the tubular body and the helical fin.

Figure 1:
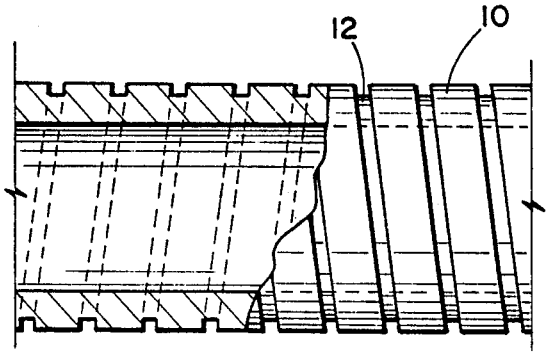
Fig. 1 PRIOR ART
FIG. 1 is a front elevation partly in section of a heat exchange tube provided with a helical groove in accordance with the teachings of the prior art.

In FIG. 1, a prior art steel tube is provided with a helical groove 12. The aluminum fin (not shown) would have a lower cross section corresponding to the shape of the groove 12. The fin would be tightly wound on the tube 10 within the groove 12 (at an ambient temperature) and the ends of the fin would be welded or otherwise secured to the tube. Upon heating, the aluminum fin would expand outwardly away from the tube 10. However, if the groove 12 were sufficiently deep, the bottom edge of the fin would still remain in contact with the tube 10.

Figure 2:
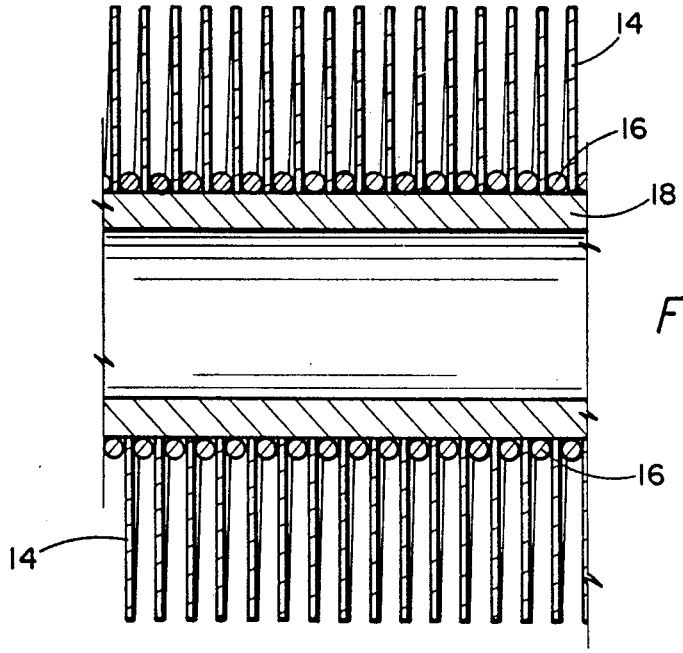
FIG. 2 is a longitudinal across sectional view of a portion of a finned tube constructed in accordance with the present invention.

In FIG. 2, an aluminum fin 14 and a steel wire 16 are fed side by side onto the surface of a steel tube 18 and are simultaneously wound thereon in the same manner that a fin is wound on a table. The fin 14 is conventionally a thin flat ribbon which will easily bend around a tube or pipe. The wire 16 will have a diameter equal to the desired spacing between adjacent fins.

In a conventional fin winding operation, the tube is rotated and moved longitudinally at the same time, while the fin, after attachment to the tube, is fed at a slight angle to the rotating tube. The result is the conventional spiral or helical winding of the fin on the tube. For the purposes of the present invention, at the beginning of the winding operation, the end of the fin will be clamped or welded to the tube and one or two windings of fin will be started on the tube. At this point, the wire, which will be positioned beside the fin, will be fed into the space between the initial windings of the fin and clamped to the tube. Thereafter, the winding operation will continue with the fin and the wire being fed simultaneously, side by side, onto the surface of the tube so that each portion of the wound wire will be snuggly disposed between two pieces of wound fin, and vice versa. The winding operation will continue until the required length of finned tube is produced at which time the ends of the fin and wire will be clamped or otherwise secured to the tube. If desired, zinc collars can be provided at the ends of the tube to cover the wound ends of fin and wire.

Thus, FIG. 2 represents an intermediate portion of a finned tube made in accordance with the present invention. As indicated above, the tube 18 is preferably made of steel. The wire is also preferably of a steel material having essentially the same coefficient of the thermal expansion as compared to the tube. Thus, the wire acts as a spacer and a continuation of the tube from the standpoint of thermal conductivity. The fin is preferably of aluminum which has a higher coefficient of expansion than the material of the tube and/or wire. Thus, if the fin 14 should expand outwardly away from the tube 18, the lower end of the fin would still remain in physical contact with the wire 16 which, in turn, is in contact with the tube 18.

Figure 3:
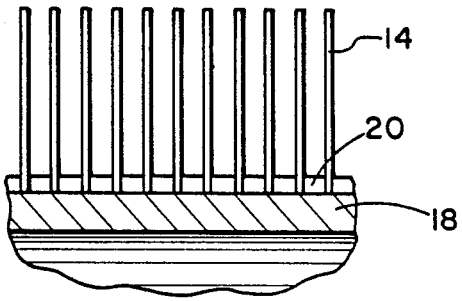
FIG. 3 is a fragmentary cross sectional view similar to the upper portion of FIG. 2, wherein the wire elements between adjacent fins are rectangular in cross section.

As shown in FIG. 3, the adjacent fins 14 are separated by a wire 20 which has a square or rectangular cross section as compared to the round wire 16 shown in FIG. 2. The fin 14 and wire 20 of FIG. 3 would be wound on the tube 18 in exactly the same manner as described above in relation to FIG. 2. The square shape of the wire 20 in FIG. 3, should improve the degree of contact slightly at the bottom of the fins 14. The longitudinal thickness or dimension of the wire 20 represents the desire spacing between adjacent fin windings.

Whereas, reference has been made to the tube 18 as being made of steel, the wires 16 and 20 being made of steel, and the fin 14 being made of aluminum, the present invention is not limited to these materials. Whenever the fin and tube are made of dissimilar materials, where the fin has a higher coefficient of expansion than the tube, the present invention can be employed just so long as the wire is made of a material having the same or smaller coefficient of expansion as compared to the tube.

Whereas, the present invention has been described in particular relation to the drawings attached hereto, other and further modifications, apart from those shown or suggested herein, may be made within the spirit and scope of this invention.

What is claimed is:

1. A method of making a finned tube from a fin having a relatively higher coefficient of expansion than that of the tube upon which the fin is wound which comprises winding the fin helically on the tube while simultaneously winding a wire in side by side relation with the fin on the surface of the tube such that each winding of wire is snuggly received between adjacent windings of fin, the wire being made of a material having the same or similar coefficient of expansion as compared to the material of the tube.

2. The method of making a finned tube as set forth in claim 1, wherein the wire has a round cross section.

3. The method of making a finned tube as set forth in claim 1, wherein the wire has a square cross section.

4. The method of making a finned tube as set forth in claim 1, wherein the wire has a rectangular cross section.

5. A finned tube for a heat exchanger comprising a hollow metallic tube having a given coefficient of theremal expansion, a fin helically wound on the tube and having a higher coefficient of thermal expansion as compared to that of the tube, and a wire helically wound on the tube between adjacent windings of fin and in abutting relationship with adjacent windings of fin, the wire havine a coeficient of thermal expansion equal to or less than the given coefficient of expansion of the tube.

6. A finned tube as set forth in claim 5, wherein the cross sectional shape of the wire is round.

7. A finned tube as set forth in claim 5, wherein the cross sectional shape of the wire is square.

8. A finned tube as set forth in claim 5, wherein the cross sectional shape of the wire is rectangular.

* * * * *